US008163156B2

(12) United States Patent
Mamaev et al.

(10) Patent No.: US 8,163,156 B2
(45) Date of Patent: Apr. 24, 2012

(54) METHOD FOR VACUUM-COMPRESSION MICRO PLASMA OXIDATION

(75) Inventors: Anatoli Ivanovich Mamaev, Tomsk (RU); Vera Aleksandrovna Mamaeva, Tomsk (RU); Pavel Igorevich Butyagin, Tomsk (RU)

(73) Assignees: Tomsk State University (TSU), Tomsk (RU); Sibspark, Limited Liability Company, Tomsk (RU)

( * ) Notice: Subject to any disclaimer, the term of this patent is extended or adjusted under 35 U.S.C. 154(b) by 148 days.

(21) Appl. No.: 12/328,938

(22) Filed: Dec. 5, 2008

(65) Prior Publication Data

US 2009/0078575 A1 Mar. 26, 2009

Related U.S. Application Data

(63) Continuation of application No. PCT/RU2007/000045, filed on Jan. 29, 2007.

(30) Foreign Application Priority Data

Jun. 5, 2006 (RU) ..... 2006119559

(51) Int. Cl.
*C25D 11/02* (2006.01)

(52) U.S. Cl. ..... 205/88; 205/135; 205/136; 205/324; 205/333

(58) Field of Classification Search ..... 205/88
See application file for complete search history.

(56) References Cited

U.S. PATENT DOCUMENTS 4,193,846 A * 3/1980 Barrett ..... 205/77
4,456,506 A 6/1984 Stein et al.
5,039,388 A * 8/1991 Miyashita et al. ..... 204/192.32
5,368,634 A * 11/1994 Hackett ..... 95/260
6,238,540 B1 5/2001 Timoshenko et al.

(Continued)

FOREIGN PATENT DOCUMENTS

JP 3259225 A 11/1991

(Continued)

OTHER PUBLICATIONS

International Search Report, mailed Jun. 28, 2007, from International Application No. PCT/RU2007/000045, filed Jan. 29, 2007.

(Continued)

*Primary Examiner* — Alexa Neckel
*Assistant Examiner* — William Leader
(74) *Attorney, Agent, or Firm* — Houston Eliseeva, LLP

(57) ABSTRACT

The inventive method and device for vacuum-compression micro plasma oxidation relate to electrochemical processing of metal, in particular to micro plasma treatment in electrolyte solutions. The aim of said invention is to develop a method for obtaining qualitatively homogeneous coatings by micro-plasma oxidation on large-sized parts, including irregular shaped parts, or simultaneously on a great number of small parts. The second aim of the invention is to design a device for processing parts, having an extended surface area, by using low-power supplies. The inventive method for vacuum-compression micro-plasma oxidation of parts consists in dipping a processable part into an electrolyte solution pre-filled in a sealed container, in generating micro-plasma discharges on the surface of said part and, subsequently, in forming a coating, wherein the micro-plasma discharges are formed in low-pressure conditions above the electrolyte solution. The device for carrying out said method comprises means for forming vacuum in the electrolyte-containing container and additional means for pumping air.

2 Claims, 6 Drawing Sheets

U.S. PATENT DOCUMENTS

2003/0196901 A1* 10/2003 Grunes ..... 205/88

FOREIGN PATENT DOCUMENTS

| | | | |
|---|---|---|---|
| RU | 2006531 | C1 | 1/1994 |
| RU | 2065895 | C1 | 8/1996 |
| RU | 2149929 | C1 | 5/2000 |
| RU | 2171865 | C1 | 8/2001 |
| RU | 2194804 | C2 | 12/2002 |
| RU | 2218454 | C2 | 12/2003 |
| RU | 2258771 | C1 | 8/2005 |
| RU | 2284517 | C2 | 9/2006 |

OTHER PUBLICATIONS

English translation of International Preliminary Report on Patentability, dated Jan. 20, 2009, from International Application No. PCT/RU2007/000045, filed Jan. 29, 2007.

* cited by examiner

Aluminum, 1 – without vacuum, 2 – vacuum

Titanium, 1 – without vacuum, 2 – vacuum

On titanium, without vacuum, on time

On titanium, in vacuum, on time

METHOD FOR VACUUM-COMPRESSION MICRO PLASMA OXIDATION

RELATED APPLICATIONS

This application is a Continuation of PCT application serial number PCT/RU2007/000045, filed on Jan. 29, 2007, which claims priority to Russian Patent Application No. RU 2006119559, filed on Jun. 5, 2006, both of which are incorporated herein by reference in their entirety.

FIELD OF THE INVENTION

Inventions belong to the field of electro-chemical metal processing, namely to micro plasma treatment in electrolyte solutions, and can be applied in machine-building and other industries.

BACKGROUND OF THE INVENTION

One of the problems related to industrial application of micro plasma (micro arc, plasma-electrolyte) oxidation method is its significant energy consumption. At present there are no power supplies that would allow treating large-sized parts or simultaneously processing a large number of parts.

Attempts have been made to reduce energy consumption of the process or apply coating to large-sized parts. Some of those attempts were aimed at selecting electric power supply modes to minimize energy expenditure; others involved mechanical displacement of parts, such as, for instance, motion of parts in relation to each other, counter electrode movement in relation to the processed part or gradual immersion into electrolyte, i.e. stage-by-stage part treatment.

There is a method (RU 2218454 C2, 2003) for obtaining wear-resistant coatings, where a technological electrical insulating layer of inorganic compounds is formed on the base surface before micro arc oxidation. Such layer allows for electric energy saving by ensuring lower energy input into formation of an outer porous technological layer and by reducing starter currents.

The disadvantage of this method is a need to apply electric insulating inorganic barrier, which results in abrupt processability and productivity drop and increases the costs of obtaining a coating. Inorganic insulating barrier is to be uniform all over the part, which is technologically difficult to achieve, and this barrier is relatively hard to apply to irregular shaped parts. Therefore, impossibility of ensuring uniform electric insulating barrier on irregular shaped parts does not allow obtaining high-quality homogeneous coatings by micro arc method, because irregular electric density results in non-uniform coating thickness.

There is a method (RU 2006531 C1, 1994) of electrolyte micro arc application of silicate coating to aluminum parts, which consists in immersing 5-10% of surface area of said part into electrolyte, while further immersion is carried out evenly at a certain speed, depending on initial current density and total surface area of the part. Initial current magnitude is 1000 A, which allows applying a 10-20 times less potent supply source.

Improvement of the above-mentioned method is a method, stipulated in (RU 2065895 C1, 1996), where stage-by-stage immersion of the part is carried out.

There is a method (RU 2149929 C1, 2000; U.S. Pat. No. 6,238,540 B1, 2001), aimed at obtaining high-quality coating for extended surface of a processed large-sized part or for a large number of small parts simultaneously. It is done by facilitating the generation of micro plasma discharges and ensuring their stable combustion. Immersion is stage-by-stage in this process. First, the area is determined depending on the power output; then further immersion, till full submersion of the part, is carried out keeping current magnitude between the electrodes within certain limits.

Gradual immersion of the part into electrolyte causes stage-by-stage expansion of an active micro-arc discharge zone, which can result in heterogeneous distribution of energy input into bare surface depending on time and, correspondingly, in heterogeneous coating properties, i.e. in obtaining low-quality coating. Parts, which were initially placed into solution, will have larger thickness. The whole article passes through electrolyte-air interface, which also causes coating defects. When parts are irregular shaped, it is impossible to ensure constant current density, as it is unpredictable in this case.

There is a method of obtaining protective coatings on the surface of metals and alloys (RU 2194804 C2, 2000), where operational device is moved along the processed surface, and device is equipped with electrode and porous screen, through which liquid electrolyte is brought in. The authors underline that unlike existing oxidation methods, where power supplies enduring current of up to 500 A are used to maintain requested current density, the suggested method is based on the use of 2 kW device, ensuring necessary process parameters to apply coating to large-sized parts.

Disadvantage of this method is a need to use a manipulator, which is to move along the surface of the part. This is especially problematic, when coating is applied to irregular shaped parts, containing holes, cavities etc. Despite the theoretic possibility of applying coatings to large surfaces, this method, however, does it at the expense of increasing the required time. Besides, a crucial disadvantage of applying small cathodes is the fact that when voltage is applied, cathode is polarized to a larger extent than the processed part. As a result significant energy loss at cathode takes place and efficient electric energy use is decreased.

There is a method for electrolytic micro arc coating application to parts made of valve metal (RU 2171865 C1, 2000), designed to obtain coatings on large-sized parts when using low-power supplies. In this method the electrode is given a specific form and an area much smaller than the area of a processed part. Coating application is carried out by electrode scanning along the surface of the part or simultaneous motion of electrode and processed part in relation to each other.

Disadvantage of this method is a need for additional equipment (manipulator), and it is impossible to process irregular shaped parts. From electrochemical point of view, economical processes are viable, when area of processed part is smaller than cathode area. In this case cathode is weakly polarized. If cathode surface is smaller than the surface of processed part, then the main voltage drop takes place on cathode and anode is weakly polarized. Speed of coating formation in this case is reduced and the time requirement increases, as it is necessary to apply coating of a given thickness on one part segment and then move cathode to a different segment. This worsens processability and productivity of this method.

SUMMARY OF THE INVENTION

The task of the present invention is to develop a method for obtaining coatings by micro plasma oxidation on large-sized parts, including irregular shaped parts, or simultaneously on a large number of smaller parts.

Another task of invention is to develop device, capable of processing parts with larger surface area using low-power supplies. Device design is determined by specific features of the method.

In order to carry out the task, the suggested method for obtaining coating on parts in the micro plasma oxidation mode involves immersion of the processed part into electrolyte solution, while hermetically sealed container is pre-filled with electrolyte. The process involves micro plasma discharge generation on the surface of said part in low-pressure conditions over electrolyte solution and consequent coating formation.

In suggested electrolyte micro plasma system the liquid boiling temperature decreases, when the pressure goes down. When electric current goes through the surface of the part, temperature of the near-electrode layer increases, which leads to vapor bubble formation on the surface; these bubbles block part of treated surface, leading to barrier layer formation and decrease in surface area available for electrode reaction. Current magnitude decreases, thus resulting in starter currents decrease.

As far as gas bubbles move along the surface and take off, there is no complete surface blockage, which allows gradually treating the whole surface of the part. In the place, where oxide layer was formed, bubble formation is less likely, because electric current in this area does not go through and electro-chemical and micro plasma process moves to a different segment on the surface of the part.

Surface blockage is also due to evolved gas. When electric current passes through, gas release is observed in water electrolyte on the basis of reaction:

$$4OH^{-}32\ 2H_2O+O_2\uparrow-4e^{-}\text{—on anode,}$$

$$2H^{+}+2e=H_2\uparrow\text{—on cathode.}$$

Initially evolved gas is on the surface of processed part, blocking it for electrode reactions and resulting in formation of a layer with increased resistance (surface decreases).

If one decreases pressure in the system, then evolved gas on electrodes starts to occupy larger volume (the same gas quantity under low pressure occupies larger volume), in accordance with Mendeleyev-Clapeyron law:

$$M=m/\mu RT=PV.$$

This leads to blockage of a larger surface area and, correspondingly, reduction in currents at initial moment of the process.

It is advisable to perform micro plasma discharge generation under the conditions of low pressure equal to that of electrolyte gas.

Further coating formation can take place at atmospheric—or higher than atmospheric—pressure, for instance, at 1-2 atm.

Micro plasma oxidation can be carried out in pulse mode or in asymmetric sinusoidal mode or in sinusoidal mode of processed part polarization.

One more inventive subject matter is a device for carrying out the above-mentioned method. The device comprises the following: hermetically sealed container for electrolyte, equipped with means for creating vacuum (low pressure) in container; power supply with two clamps; first electrode, immersed in electrolyte, including at least one processed part and connected to the first power supply clamp; and second electrode, immersed in electrolyte or containing electrolyte, when container is used for electrolyte as a second electrode, and connected to the second power supply clamp.

Moreover, the device comprises means for feeding compressed air into container.

It is advisable to equip electrolyte container with a cover, having compaction for its hermetical sealing.

It is also advisable that the second electrode be immersed in electrolyte and serve as a cathode.

The above and other features of the invention including various novel details of construction and combinations of parts, and other advantages, will now be more particularly described with reference to the accompanying drawings and pointed out in the claims. It will be understood that the particular method and device embodying the invention are shown by way of illustration and not as a limitation of the invention. The principles and features of this invention may be employed in various and numerous embodiments without departing from the scope of the invention.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings.

DETAILED DESCRIPTION OF THE PREFERRED EMBODIMENTS

Processed part as one of electrodes (anode) and the second electrode (cathode) are placed into container with electrolyte solution; container is hermetically sealed, electrodes are connected to power supply.

First, pressure in the system is pumped out to reach the pressure of liquid vapors (lower level does not make sense, as it leads to electrolyte boiling).

Then power supply is switched on, gas bubbles are formed on the surface of the part. They block part of processed surface, then micro plasma discharges are generated and oxide-ceramic layer is formed on the surface.

As thickness of oxide-ceramic layer increases, pressure in the system can be increased up to atmospheric level by letting the gas in, and necessary coating thickness can be formed under normal conditions.

The increase in pressure over the atmospheric level leads to decrease in volume occupied by evolved gas on the surface of the part (the gas is released in pores), partially opening the surface, and this allows applying thicker coatings.

Micro plasma oxidation in pulse mode of processed part polarization is preferable.

Evidence is provided by experimentally obtained current and voltage pulse values, as well as voltammetric curves determined on their basis with the use of computer measurement system (CMS), described in detail in (RU 2284517 C1, 2006).

Figure 4:
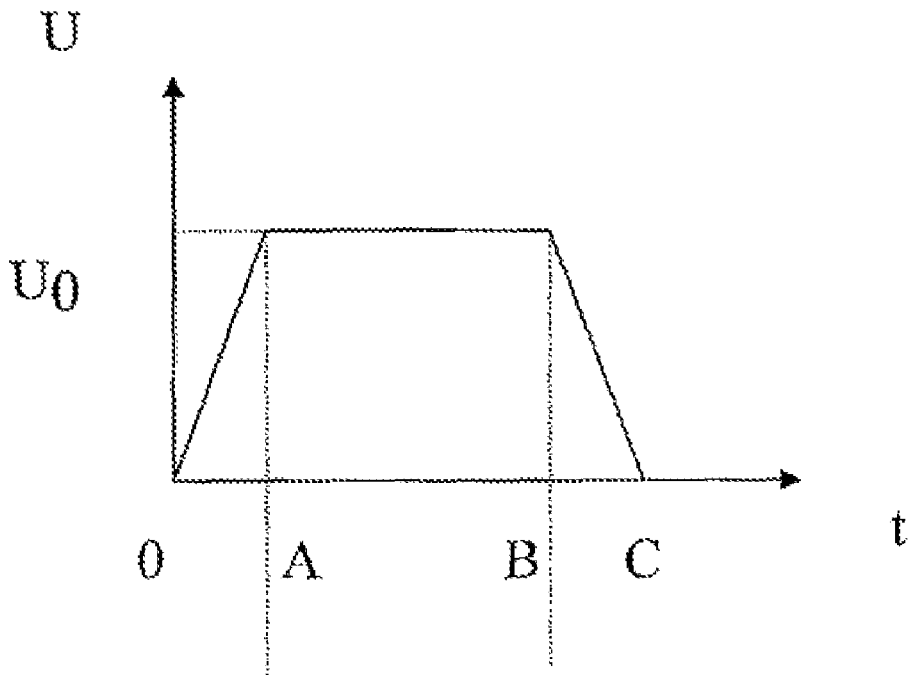
FIG. 4 represents a form of voltage pulse.

In order to obtain the value of voltammetric curve, trapezoidal voltage pulse (FIG. 4) with ascending OA and descending BC segments was used. CMS records relevant current pulse (FIG. 5) and thus, knowing values of current and voltage at certain moments of time on descending and ascending parts of voltage pulse, one can obtain dependence of current on voltage (FIG. 6).

Figure 5:
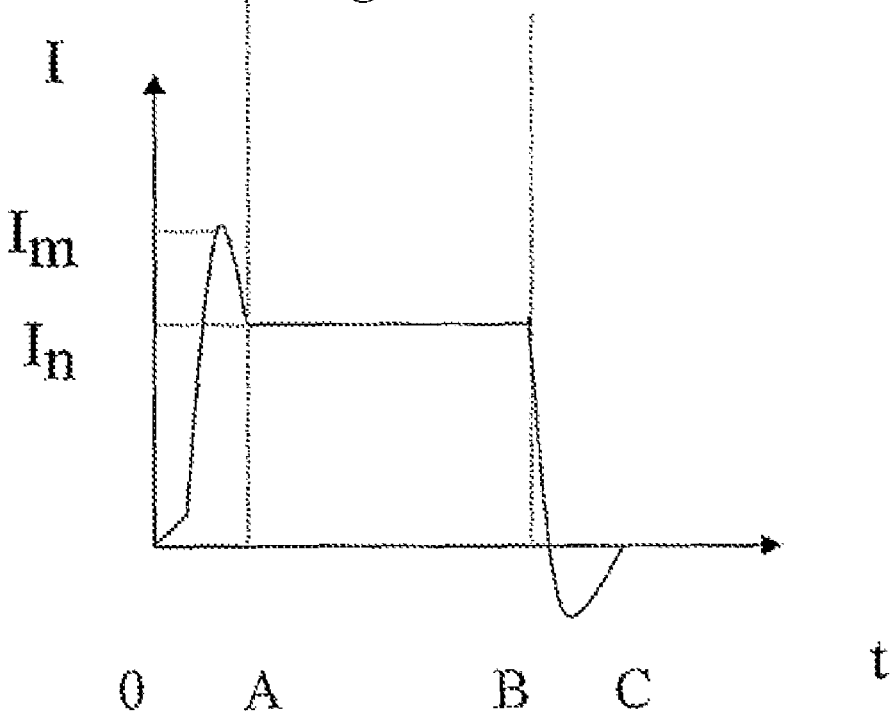
FIG. 5 represents a form of current pulse.
Figure 6:
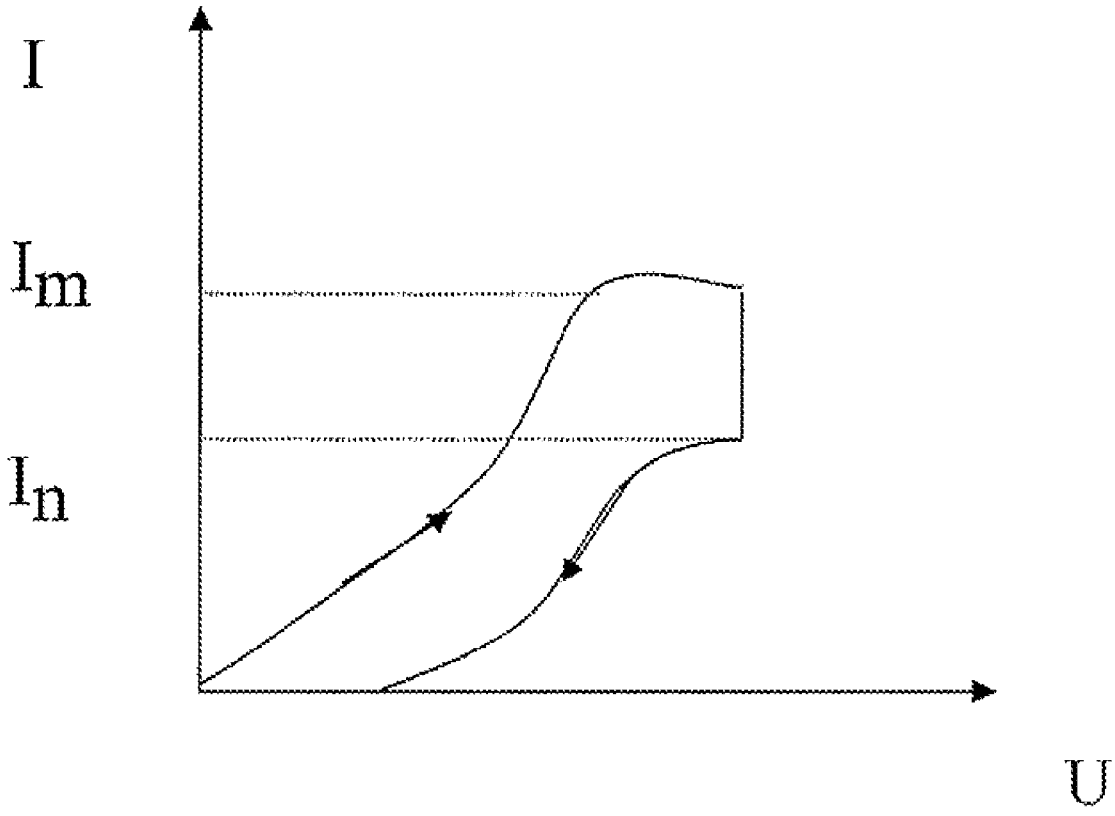
FIG. 6 represents a voltammetric curve.

FIG. 6 represents voltammetric curve, where current value $I_m$ corresponds to current maximum in FIG. 5. Value $I_n$ corresponds to active current (at this moment dU/dt=0) and value of the system capacity current $I_c$=0 (C—pseudo-capacity, S—area) corresponds to site current in FIG. 6.

Active current is a base value for identifying the quality of energy, spent in the process: $P=U_oI_nt$, where $U_o$ is maximum voltage pulse, $I_n$ is current pulse site, t is pulse duration. Therefore, decrease in current magnitude indicates change in spent energy at invariable values of maximum applied voltage and pulse duration.

Figure 1:
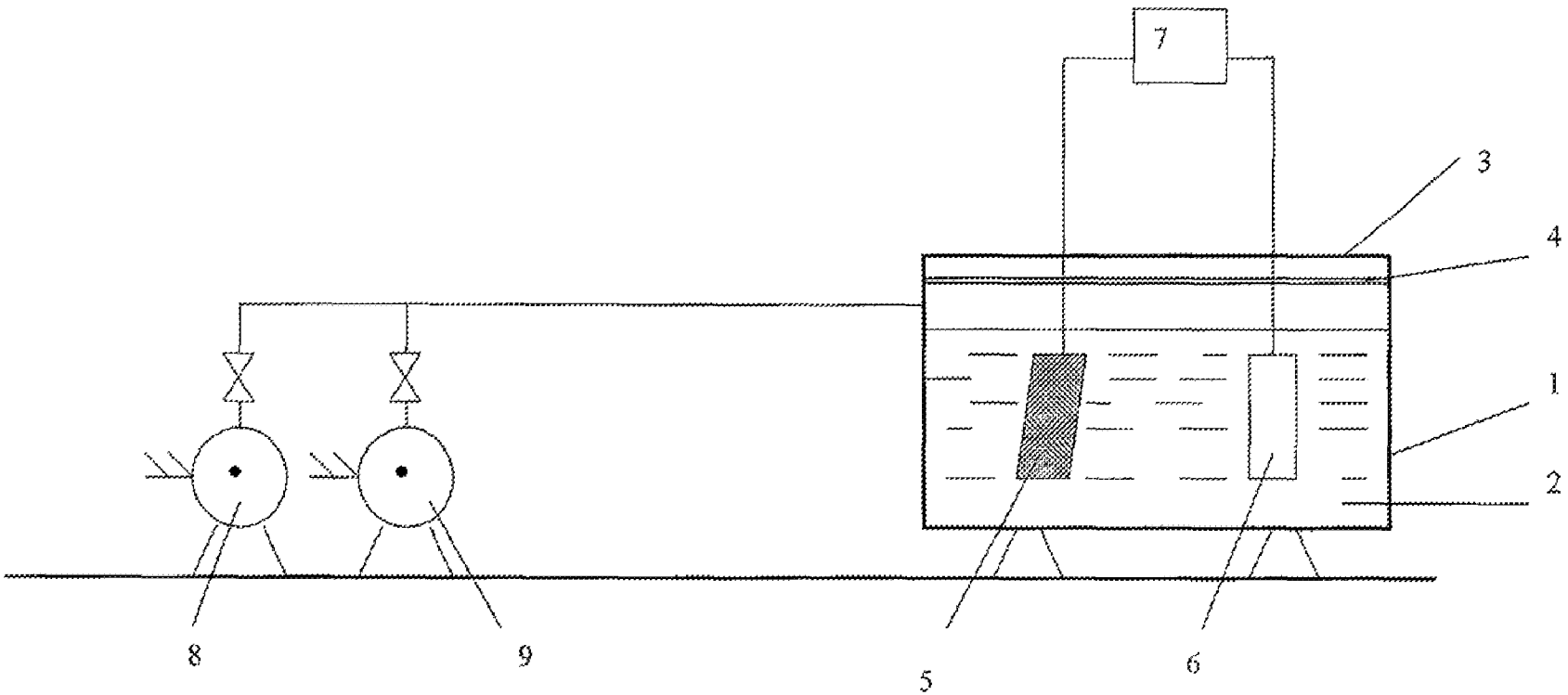
FIG. 1 represents a device for coating application in low-pressure conditions.

Device for implementing the method (FIG. 1) comprises container 1 with electrolyte solution 2, hermetic cover 3 for container 1 and compaction system 4. Processed part 5 as one of electrodes (anode) and the second electrode 6 (cathode) are placed in container 1; they are both designed to connect to power supply 7. Device comprises vacuum pump 8 and force pump 9, designed to connect to container 1, for instance, by connecting pipes (not shown), located in hermetic cover 3.

Device functions in the following way:

Processed part 5 as anode and cathode 6 are placed into container 1 with electrolyte solution 2 and are connected to power supply clamps 7. Before connecting electrodes to power supply, vacuum is created under cover 3 (low pressure) by vacuum pump 8. Pulse power supply with 50 Hz frequency, voltage of up to 600 V and rectangular pulse duration of 50-1000 mcs, as well as power supply with sinusoidal current type of 50 Hz frequency and voltage of up to 600 V were used to generate micro plasma discharges. Subsidiary electrode (cathode) was made of stainless steel.

Example 1

In order to obtain oxide-ceramic coating of the sample (processed part) 5 made of aluminum alloy with surface area of 3.8 $cm^2$, the sample was placed into electrolyte 2. Container 1 was hermetically sealed and vacuum was created by vacuum pump 8 under the cover 3. Low pressure was made equal to electrolyte vapor pressure (three-component phosphate-borate electrolyte). Then power supply 7 was connected to electrodes. Applied voltage of 300 V, anode mode (current density of 100-300 $A/dm^2$), pulse duration of 200 mcs. Micro plasma discharges were generated on sample surface and oxide-ceramic coating was formed.

Example 2

Figure 2A:
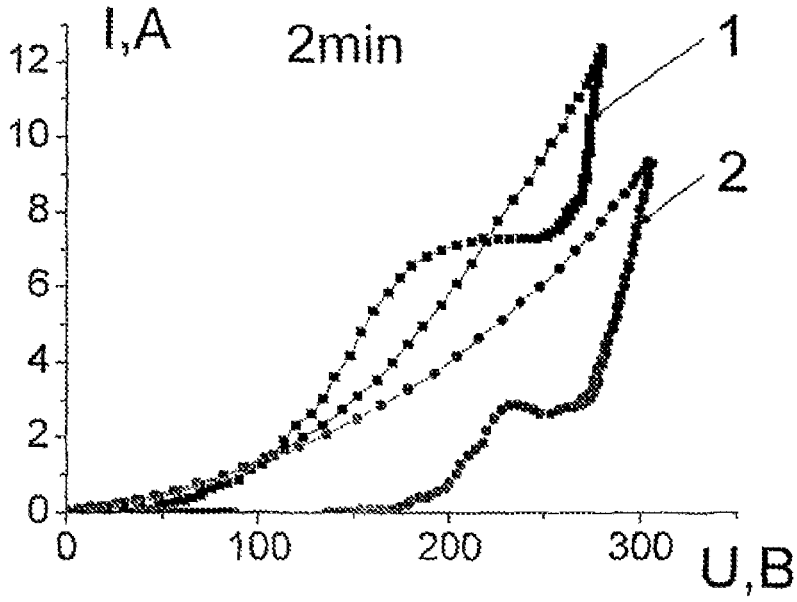
FIG. 2 represents comparative voltammetric curves of micro plasma processes in low-pressure conditions and under atmospheric pressure for aluminum and titanium at the time point of 2 minutes.

Under the same conditions, oxide-ceramic coating was obtained on a similar sample, but under atmospheric pressure (force-pump 9 was used to obtain atmospheric pressure). FIG. 2*a* shows voltammetric curves of above-mentioned processes at the time point of 3 minutes: curve 1 without vacuum, curve 2 under vacuum conditions.

Curve comparison demonstrates that current of the process in vacuum is significantly lower than current of the process under atmospheric pressure.

Example 3

Figure 2B:
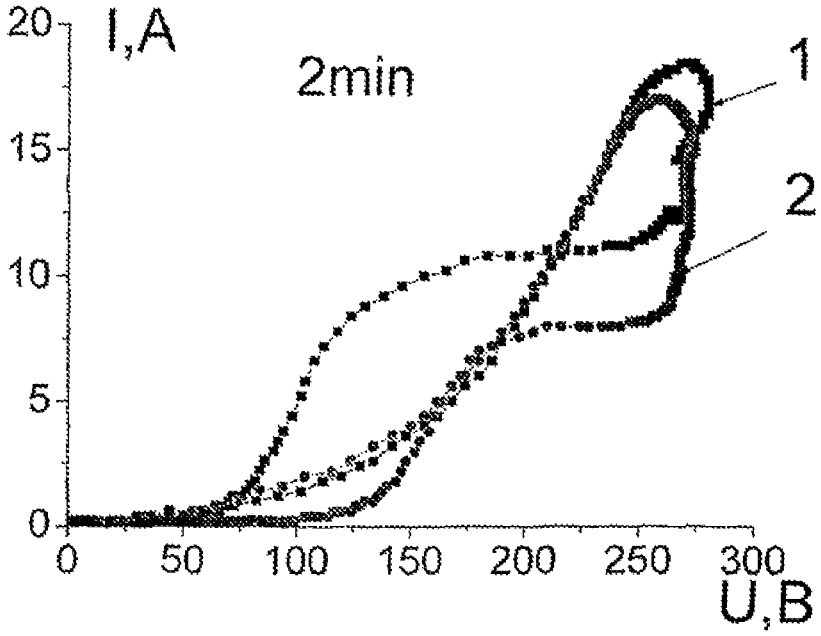

All conditions of the process are analogous to conditions in examples 1 and 2, except for the fact that coating was applied to sample made of titanium alloy (with surface area of 3.8 $cm^2$). FIG. 2*b* shows comparative voltammetric curves of processes in vacuum and under atmospheric pressure.

Curve comparison demonstrates that current of the process in vacuum is lower than current of the process under atmospheric pressure.

Example 4

Figures 3A, 3B:
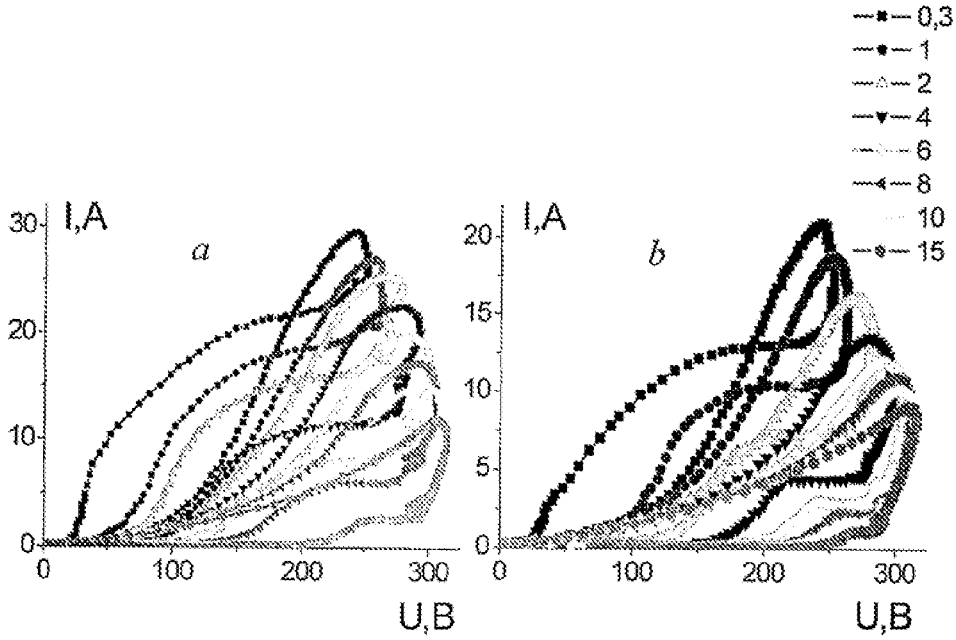
FIG. 3 represents comparative voltammetric curves of micro plasma processes in low-pressure conditions and under atmospheric pressure for aluminum and titanium for the period of 15 minutes.

All conditions of the process are analogous to conditions in example 3. FIGS. 3*a* and 3*b* show comparative voltammetric curves of processes for the period of 15 minutes, in vacuum (3*b*) and under atmospheric pressure (3*a*), confirming the presence of lower current magnitudes in the course of the process of applying coating in vacuum.

Figure 7A:
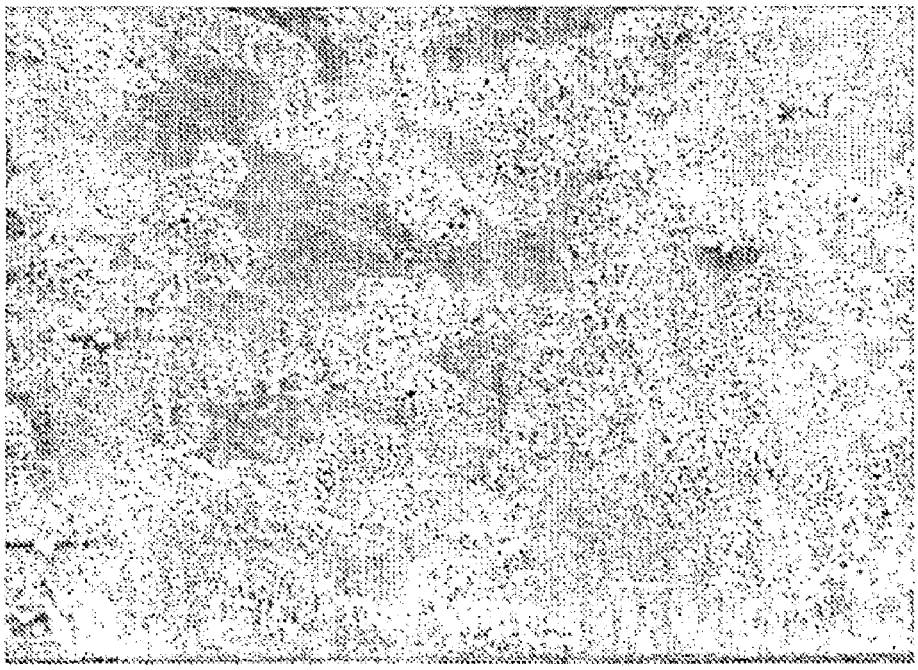
FIG. 7 represents microphotographs of the surface of the sample made of titanium alloy, processed under atmospheric pressure and in vacuum conditions for the period of 1 minute.
Figure 7B:
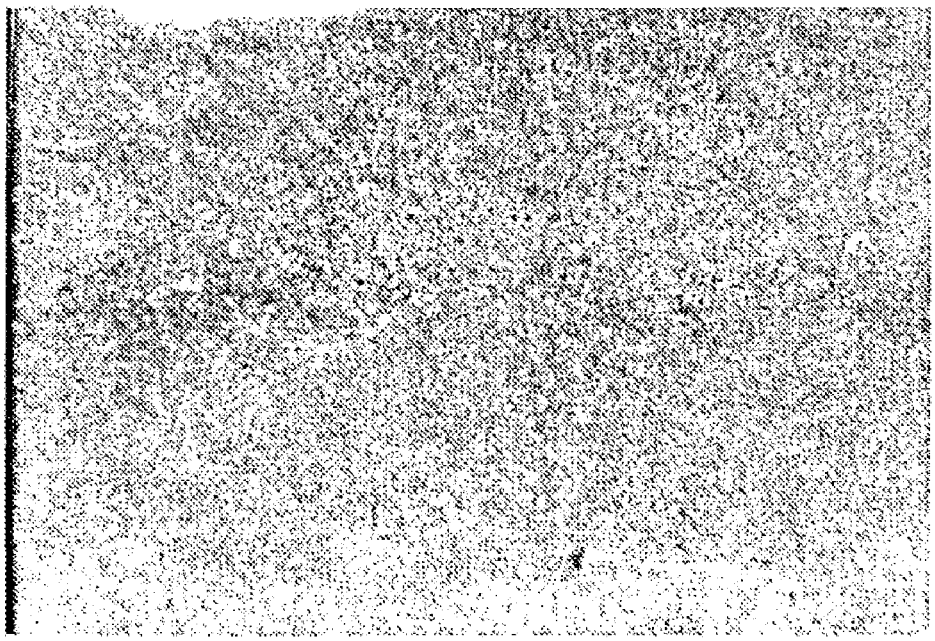

FIG. 7*a* shows surface microphotographs of the sample made of titanium alloy, processed under atmospheric pressure, and FIG. 7*b* shows surface microphotographs of the analogous sample processed in vacuum for the period of 1 minute. Comparative analysis demonstrates that coating is applied more uniformly in vacuum.

Example 5

In the course of 2 minutes coating was formed under conditions of example 3 and coating thickness was measured. Coating thickness of the sample processed in vacuum was 12 micron and it was 20 micron without vacuum. In order to form thicker coatings and accelerate coating application, pressure was increased to atmospheric level.

Example 6

In order to obtain oxide-ceramic coating on the sample (processed part) 5 made of titanium alloy with surface area of 3.8 $cm^2$, the said sample was placed in electrolyte 2. Container 1 was hermetically sealed and vacuum pump 8 was used to create vacuum under cover 3. Low pressure was set equal to electrolyte vapor pressure (water solution NaOH, concentration of 100 g/l). Then power supply 7 with sinusoidal current type was connected to electrodes. Applied voltage was 300 V, frequency was 50 Hz. Micro plasma discharges were generated on sample surface and oxide-ceramic coating was formed.

The table lists comparative values of current density for processes in pulse (example 4) and sinusoidal modes in vacuum and without vacuum for the period of 15 minutes with the same applied voltage.

TABLE

| | Sinusoidal mode Ia, A $dm^2$ | Pulse mode Ia, A $dm^2$ |
|---|---|---|
| Under atmospheric conditions, U = 300 V | 40 | 160 |
| Under low-pressure conditions, U = 300 V | 32 | 100 |

The table demonstrates that reduction of currents takes place both in pulse and in sinusoidal modes of oxide-ceramic coating formation.

INDUSTRIAL APPLICABILITY

As noted before, one of the problems of industrial application of micro arc oxidation method is its high energy consumption. Suggested method of vacuum-compression micro plasma oxidation (VCMPO) vacuumizes electrolytic micro plasma system and thus creates conditions for reduction of currents both at the initial moment and in the course of further coating formation. This allows reducing power supply load and decreasing power intensity of the process, thus increasing the surface of processed parts. Additional technical effect consists in obtaining more homogeneous coatings.

While this invention has been particularly shown and described with references to preferred embodiments thereof, it will be understood by those skilled in the art that various changes in form and details may be made therein without departing from the scope of the invention encompassed by the appended claims.

What is claimed is:

1. A method of oxide-ceramic coating of an article comprising:

immersing the article into an electrolyte solution in a container, wherein the electrolyte solution comprises a solvent having a vapor pressure;

connecting the article immersed in the electrolyte solution in the container to a power supply as an anode;

connecting the container or an electrode immersed in the electrolyte solution to the power supply as a cathode;

hermetically sealing the container;

creating above the electrolyte solution in the hermetically sealed container a gas pressure substantially equal to the vapor pressure of the solvent of the electrolyte solution; and while the gas pressure above the electrolyte solution in the hermetically sealed container is substantially equal to the vapor pressure of the solvent of the electrolyte solution, applying a sufficient power-supply voltage between the article and the cathode to form gas bubbles on a surface of the article thereby blocking a part of the surface and, in the presence of the gas bubbles on the surface, to generate micro-plasma discharges to form oxide-ceramic coating on a the surface of the article.

2. The method of claim 1 further comprising, subsequent to the steps of claim 1:

creating above the electrolyte solution in the hermetically sealed container a gas pressure equal to at least 1 atm by introducing gas into the container; and while the gas pressure above the electrolyte solution in the hermetically sealed container is at least 1 atm, applying a sufficient power-supply voltage between the article and the cathode to form further oxide-ceramic coating on an oxide-ceramic coated surface of the article;

wherein the gas is air.

* * * * *